US006874936B2

(12) United States Patent
Gillis et al.

(10) Patent No.: US 6,874,936 B2
(45) Date of Patent: Apr. 5, 2005

(54) STRAP-ON WASTE CONTAINER

(75) Inventors: Gary A. Gillis, Ann Arbor, MI (US); Donald J. Propp, Dewitt, MI (US)

(73) Assignee: Tri-State Hospital Supply Corporation, Howell, MI (US)

( * ) Notice: Subject to any disclaimer, the term of this patent is extended or adjusted under 35 U.S.C. 154(b) by 68 days.

(21) Appl. No.: 10/348,657

(22) Filed: Jan. 21, 2003

(65) Prior Publication Data

US 2004/0141662 A1 Jul. 22, 2004

(51) Int. Cl.[7] ..... B65D 33/14
(52) U.S. Cl. ..... 383/22; 383/33; 224/611
(58) Field of Search ..... 383/13, 22, 24, 383/33, 77; 224/148.5, 148.6, 257–258, 607, 611, 928

(56) References Cited

U.S. PATENT DOCUMENTS 2,943,660 A * 7/1960 Seeger ..... 383/13
3,186,626 A * 6/1965 Shvetz ..... 383/37
3,217,971 A * 11/1965 Shvetz ..... 383/203
3,346,883 A * 10/1967 Ersek ..... 4/661
3,693,192 A * 9/1972 Knotts ..... 4/267
3,774,838 A * 11/1973 Christie ..... 383/77
3,865,303 A * 2/1975 Korn ..... 383/62
4,610,039 A * 9/1986 Stern ..... 4/285
4,919,546 A * 4/1990 Imazeki et al. ..... 383/33
5,647,670 A * 7/1997 Iscovich ..... 383/33

* cited by examiner

*Primary Examiner*—Jes F. Pascua
(74) *Attorney, Agent, or Firm*—Fildes & Outland, P.C.

(57) ABSTRACT

A strap-on waste container for receiving thrown up stomach contents includes an elongated moisture proof bag having an open end, a rigid ring connected to the bag open end, and an elongated neck strap connected on one end to the ring. The neck strap allows for hands free use of the container so that the user or an assistant need not hold the container. The neck strap further includes a fabricated stress riser that causes the neck strap to break through the application of a threshold force, allowing for easy removal of the neck strap and container.

8 Claims, 1 Drawing Sheet

STRAP-ON WASTE CONTAINER

TECHNICAL FIELD

This invention relates to a strap-on waste container for receiving thrown up stomach contents.

BACKGROUND OF THE INVENTION

Often times health care providers have to deal with patients who have a high probability of getting sick to their stomach and vomiting. Such a situation occurs regularly in emergency rooms in hospitals and clinics.

Conventional waste containers are known that are hand held by patients and health care providers. These include various vomit bags, dishes and bowls. However in many situations the patient or user of the vomit collecting device cannot do so on their own because of some incapacity. These patients require assistance from another to hold and handle the vomit collecting device which is not only unpleasant, if the user vomits, but also, in an emergency medical situation, ties up another health care provider.

SUMMARY OF THE INVENTION

The present invention provides a strap-on waste container for receiving thrown up stomach contents that allows for hands free use of the container whereby the container can be worn around the neck of a patient and easily removed for disposal by the patient or a health care attendant.

According to the invention the strap-on waste container for receiving thrown up stomach contents includes an elongated moisture proof bag having an open end. A rigid ring is integrally connected to the bag open end. An elongated neck strap is connected to the bag open end and ring and includes a neck connecting portion. The strap includes a fabricated stress riser formed therein between the end connected to the bag and the neck connecting portion. The neck strap is frangible and caused to break along the stress riser through the application of any inadvertent threshold force which might become applied to either the bag, collar, strap, or patient. In the absence of such frangible feature, the patient might be strangled.

In one embodiment the bag comprises a synthetic resin film such as a polyethylene film. Likewise the neck strap comprises a synthetic resin film such as a polyethylene film.

The fabricated stress riser may be a partial cut, a scored line or a perforated line or other weakness formed in the neck strap.

In one arrangement the neck strap includes two ends connected to the bag open end and ring and the neck connecting portion is therebetween the two ends.

A method for collecting thrown up stomach contents comprises:

integrally connecting an elongated moisture proof bag open end to a rigid ring;

connecting a frangible neck strap having an end connecting said bag open end and ring, and a neck connecting portion, to the bag open end and ring;

whereby said neck strap is breakable through the application of a threshold force.

These and other features and advantages of the invention will be more fully understood from the following detailed description of the invention taken together with the accompanying drawings.

DETAILED DESCRIPTION OF THE INVENTION

Figures 1, 1A:
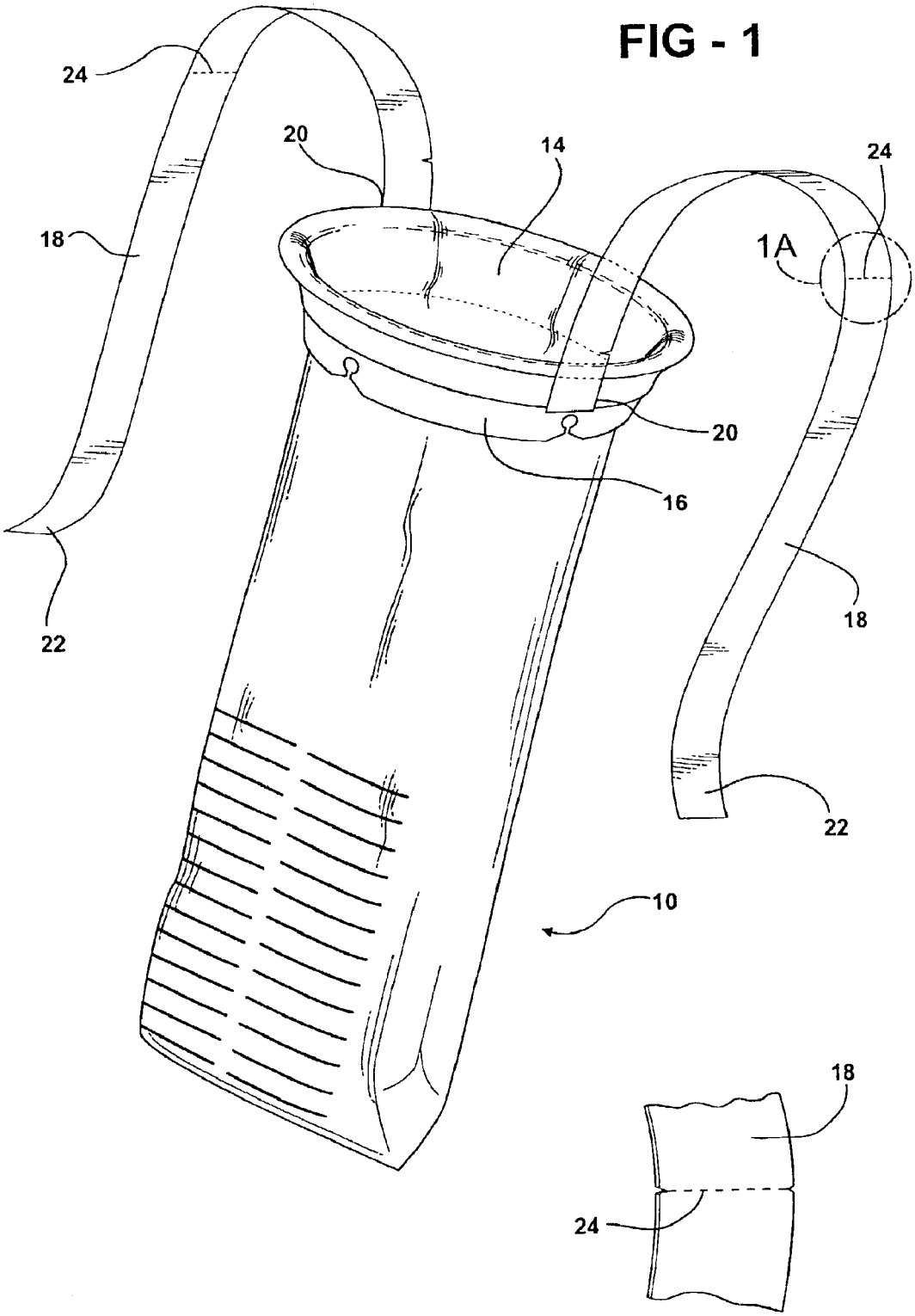
FIG. 1 is a perspective view of a strap-on waste container constructed in accordance with the present invention featuring a frangible section or stress riser portion in the waste container neck strap.
FIG. 1A is an exploded view of the frangible section or stress riser portion of the neck strap.

Referring now to the drawings in detail, numeral 10 generally indicates a strap-on waste container comprising an elongated moisture proof bag 12 having an open end 14. A rigid ring 16 integrally connects to the bag open end 14 and maintains the bag open end 14 in an open disposition of the bag. The strap-on waste container 10 further comprises an elongated neck strap 18 that has a bag connecting end 20 connecting to the ring 16 at the bag open end 14 and a neck connecting portion 22. In the embodiment illustrated, two elongated neck straps 18 are connected to opposite sides of ring 16. The elongated neck strap 18 includes a fabricated stress riser 24 formed therein along the width of the neck strap 18 in an area between the bag connecting end 20 and the neck connecting portion 22. Application of a threshold force causes the neck strap 18 to break at the stress riser 24.

With further reference to FIGS. 1 and 1A, bag 12 comprises a synthetic resin film such as polyethylene. Neck strap 18 also comprises a synthetic resin film such as polyethylene. Fabricated stress riser 24 may be a scored line, a partial cut thru or a perforated line in neck strap 18 between the connecting end 20 and neck connecting portion 22. Fabricated stress riser 24 may also be a structural feature in the polyethylene which renders the neck strap 18 frangible and allows the neck strap to be easily broken upon the application of a threshold force.

In a method for collecting thrown up stomach contents an elongated moisture proof bag open end is connected to a rigid ring. A frangible neck strap having an end connecting the bag open end and ring, and a neck connecting portion is connected to the bag open end and ring. The neckstrap is breakable through the application of a threshold force.

In use, the bag 12 is positioned about the chest of the user. The neck connecting portions 22 of the neck strap 18 are tied together to support the bag 12 and suspend the bag from the neck of the user. Upon receipt of stomach contents the bag 12 can be easily and quickly removed for immediate disposal by tugging downwardly to apply a threshold force on the frangible neck strap 18 or the neck straps 18 are untied from behind the user's neck. The removed bag 12 is quickly and easily disposed of.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A strap-on waste container for receiving thrown up stomach contents from a patient, said container comprising:

an elongated moisture proof bag having an open end;

a rigid ring integrally connecting said bag open end;

an elongated neck strap having an end connected to said ring at said bag open end and a neck connecting portion; and said strap including a fabricated stress riser formed therein between said bag connecting end and said neck connecting portion;

whereby said neck strap is caused to break along said stress riser through the application of a threshold force.

2. A strap-on waste container as in claim 1 wherein said bag comprises a synthetic resin film.

3. A strap-on waste container as in claim 2 wherein said film comprises polyethylene.

4. A strap-on container as in claim 1 wherein said neck strap comprises a synthetic resin film.

5. A strap-on container as in claim 4 wherein said film comprises polyethylene.

6. A strap-on container as in claim 5 wherein said fabricated stress riser is a perforated line.

7. A strap-on container as in claim 1 wherein said neck strap includes two ends connected to said bag open end and ring having said neck connecting portion therebetween.

8. A method for collecting thrown up stomach contents comprising the steps of:

integrally connecting an elongated moisture proof bag open end to a rigid ring;

connecting a frangible neck strap having an end connecting said bag open end and ring, and a neck connecting portion, to the bag open end and ring;

whereby said neck strap is breakable through the application of a threshold force and placing said bag and ring on a user's chest and tying said neck straps behind the user's neck to secure said bag at the ready without the user needing to hold said bag.

* * * * *